United States Patent [19]

Sweitzer et al.

[11] 4,159,101

[45] Jun. 26, 1979

[54] JACKET FOR A MOLD

[75] Inventors: Richard G. Sweitzer; Edwin R. McIntier, both of Madison, Conn.

[73] Assignee: I. S. Spencer's Sons, Inc., Guilford, Conn.

[21] Appl. No.: 858,174

[22] Filed: Dec. 7, 1977

[51] Int. Cl.[2] ..... B28B 7/00

[52] U.S. Cl. ..... 249/219 R; 249/164

[58] Field of Search ..... 425/451, 9; 249/48–49, 249/162, 164, 219 R; 269/41, 42

[56] References Cited

U.S. PATENT DOCUMENTS

| | | | |
|---|---|---|---|
| 836,798 | 11/1906 | Brookshier et al. | 249/49 |
| 1,473,964 | 11/1923 | Moore | 249/49 |
| 3,371,904 | 3/1968 | Low | 249/219 R |
| 3,652,076 | 3/1972 | McIntier | 249/48 |

*Primary Examiner*—Roy Lake
*Assistant Examiner*—John McQuade
*Attorney, Agent, or Firm*—Dike, Bronstein, Roberts, Cushman and Pfund

[57] ABSTRACT

A jacket for a multi-sided mold comprising separate side members for the sides of the mold, connected at their ends for simultaneous movement of each side member against its side of the mold, each side member being adjustable in length and including a pressure-applying panel removably suspended thereon, and hanging tackle at two of the opposite sides of the jacket for suspending the jacket above a mold with the side members diverging downwardly.

16 Claims, 14 Drawing Figures

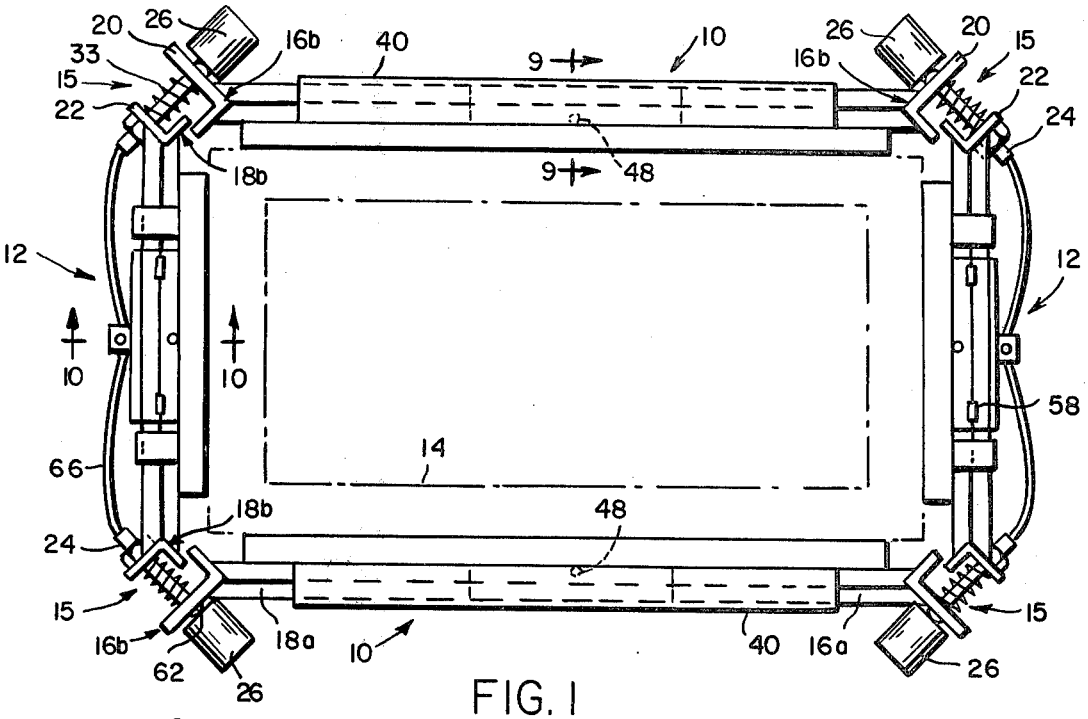
FIG. 1
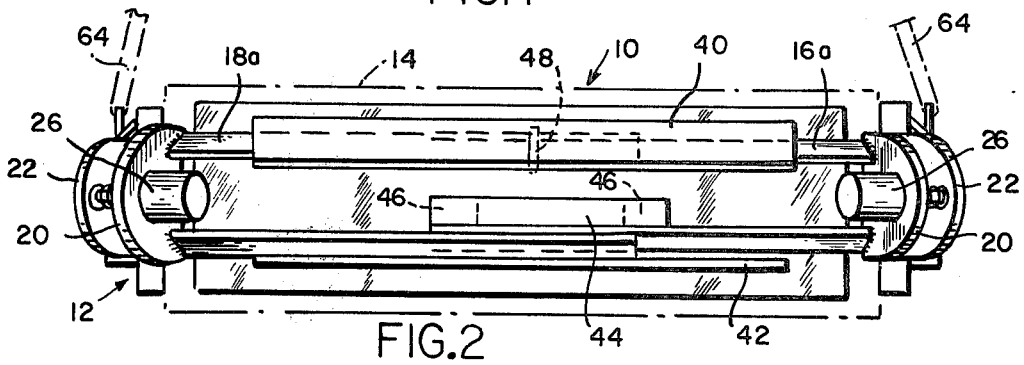
FIG. 2
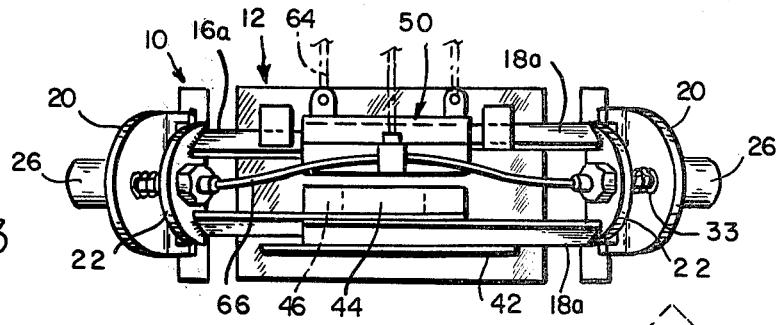
FIG. 3
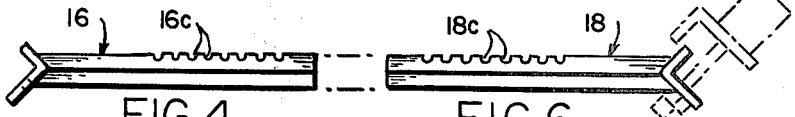
FIG. 4
FIG. 6
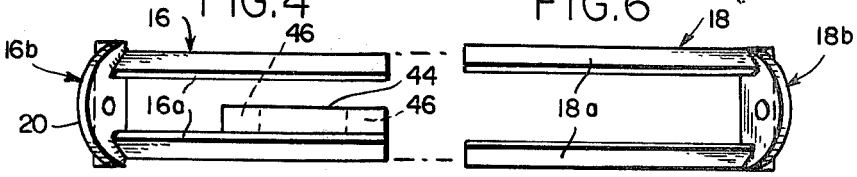
FIG. 5
FIG. 7

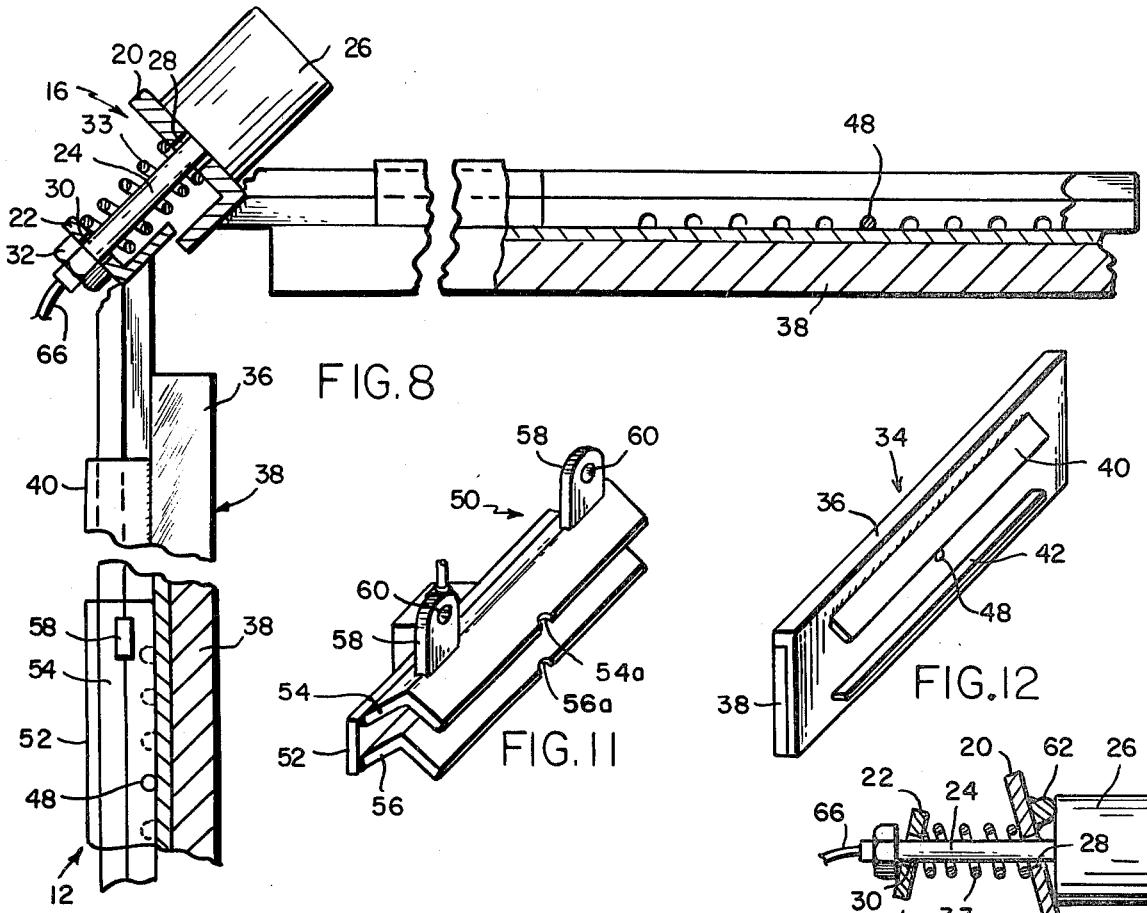
FIG. 8
FIG. 11
FIG. 12
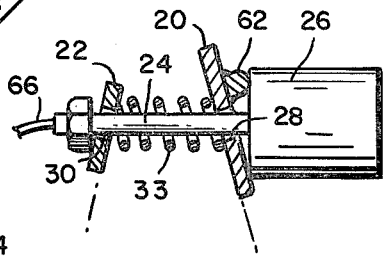
FIG. 13
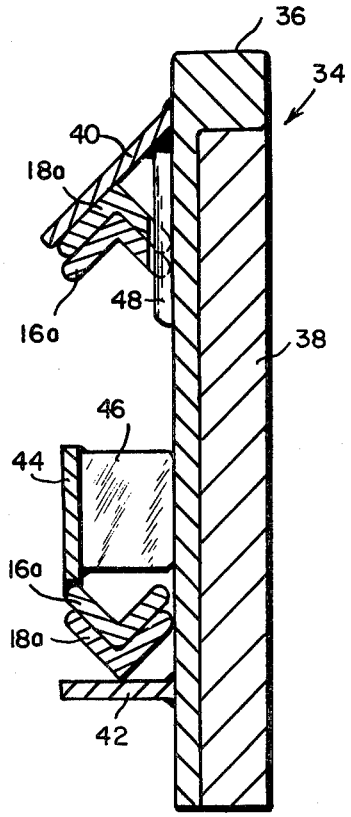
FIG. 9
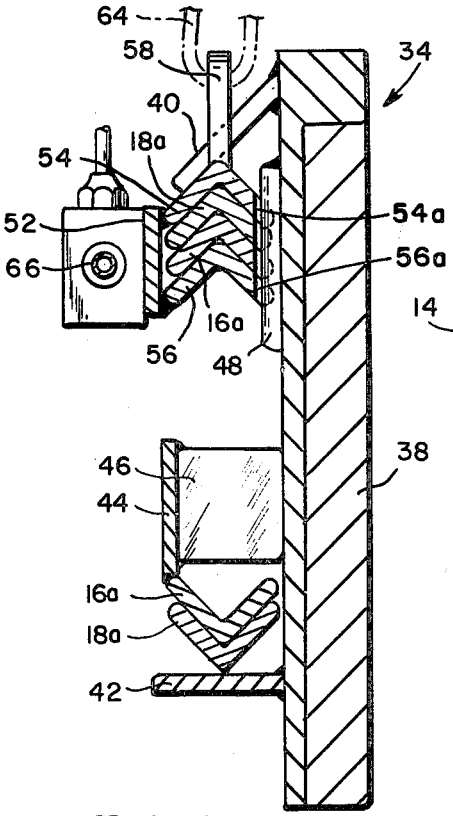
FIG. 10
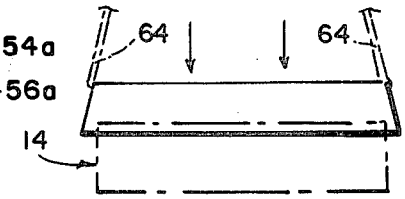
FIG. 14

JACKET FOR A MOLD

BACKGROUND OF THE INVENTION

In U.S. Pat. Nos. 3,652,076 and 3,665,815 issued to Edwin R. McIntier there is shown a jacket for applying pressure to the sides of the mold in which the sides of the jacket are of predetermined fixed length so that it is necessary to keep as many size jackets on hand as there are different sized molds. The jackets there shown comprise side members corresponding in number to the sides of the mold and pressureactuated devices at the corners of the side members of simultaneously moving all the side members to press each side member into engagement with its side of the mold. Structures of this kind, except that the side members are manually moved into engagement with the sides of the mold by lever means or by bolts, are shown in Mitchell, U.S. Pat. No. 2,903,777 and Beckman, U.S. Pat. No. 3,260,493. The jacket as herein disclosed is of the kind shown in the aforesaid patents, designed so as to accommodate molds of different size so that one such jacket is capable of use for a relatively large range of mold sizes, and so designed as to enable accommodating the jacket to a mold of predetermined size with very little effort. The jacket, as will be described, is relatively inexpensive to manufacture and is adapted to be lowered from a suspended position above the mold into a position of clamping engagement therewith and has for this purpose novel suspending tackle which holds the sides of the mold in downwardly divergent positions with respect to each other.

SUMMARY OF THE INVENTION

The jacket as herein illustrated is for a multi-sided mold and comprises separate side members for the sides of the mold, means at the ends of the side members connecting said ends, said means being operable to simultaneously move all of the side members to press each side member against its side of the mold and means for adjusting the length of each side member relative to its side of the mold. Each side member comprises longitudinally interengaged parts slidable relative to each other to change their overall length and means for fixing the parts at a predetermined position of elongation. A panel is suspended on each side member so as to present a planar surface parallel to the side of the mold. The interengageable parts of each side member comprise two pairs of spaced, parallel bars wherein the bars of one pair are slidably interengaged with the bars of the other pair and the panel is suspended from the upper bars in engagement with the lower bars. For suspending the panel, there is a rigid plate secured at an acute angle to the outer side of the panel for engagement over the upper bars and a rigid plate secured at right angle to the outer side of the panel for engagement with the lower bars. There is also means for holding the panel to the lower bars, specifically a magnet attached to the lower bars with which the outer sides of the panels become engaged. The upper bars of the side members contain at their inner sides longitudinally-spaced notches and there is a protuberance on the outer side of the panel engageable within the notches of the bars to lock the bars at a predetermined position of longitudinal adjustment. The jacket is suspended above the mold to which it is to be applied by tackle and there are means at two opposite sides of the jacket for receiving tackle comprising a yoke at each end having spaced, parallel bars for receiving the upper bars of the pairs of bars at the ends and eyes to which the tackle comprising cables can be attached. The means for moving the side members into compressive engagement with the sides of the mold are fluid-operable cylinders, and piston rods extending from the cylinders through openings in the plates at the ends of the side parts. The cylinders are disposed at the outer side of the plates of one part with their rods extending through the openings in the parts and with nuts applied to the ends at the outer side of the opposed plates. Coiled springs are mounted on the rods between the plates. The piston rods permit movement of the side members about their longitudinal axes so that when the jacket is suspended, the panels diverge downwardly relative to the sides of the mold.

The invention will now be described in greater detail with reference to the accompanying drawings, wherein:

FIG. 1 is a plan view of the mold jacket with the sides distended;

FIG. 2 is a front elevation of the jacket shown in FIG. 1;

FIG. 3 is an end elevation of the jacket shown in FIG. 1;

FIG. 4 is a plan view of one of two elongate parts comprising a side member of the jacket;

FIG. 5 is an elevation of FIG. 4;

FIG. 6 is a plan view of the other one of the elongate parts of a side member;

FIG. 7 is an elevation of FIG. 6;

FIG. 8 is a fragmentary view of much larger scale, partly in plan view and partly in section, of two adjacent side members and the means connecting their adjacent ends;

FIG. 9 is an enlarged section taken on the line 9—9 of FIG. 1;

FIG. 10 is an enlarged section taken on the line 10—10 of FIG. 1;

FIG. 11 is a perspective view of a hanger yoke, one of which is used at each end of the jacket;

FIG. 12 is a perspective view of a single panel and the means for suspending it from the side members;

FIG. 13 is a view partly in elevation and partly in section showing the divergence of the side parts when the jacket is suspended; and FIG. 14 shows the jacket suspended above a mold, the latter being shown in phantom.

Referring to the drawings, FIG. 1, the jacket is of rectangular configuration comprising rectangularly-arranged, spaced, parallel side members 10—10 and spaced, parallel side members 12—12 connected at their ends for simultaneous movement of all of the side members to press each side member against its side of a mold indicated in dot and dash lines at 14 by means of pneumatically-operated means 15 at each of the corners of the jacket. In the aforesaid patents, the side members are inextensible in length.

In accordance with this invention, sides 10—10 and 12—12 are made ajustable so as to enable extending or contracting the lengths of the sides to accommodate the jacket to molds of different size. To this end, each of the side members 10 and 12 is comprised of two slidably interengageable parts 16,18, as shown in FIGS. 4, 5, 6 and 7, and each part 16,18 comprising spaced, parallel bars **16*a*—16*a* and 18*a*—18*a* welded at one end to end members 16*b*,18*b*. The bars 16*a*, 18*a*, as shown in FIG. 9, are of right-angular section and are fastened at their ends to end members 16*b*—18*b* with their open sides facing each other. Bars 16*a*—16*a*** are closer together than the bars 18*a*—18*a* so that the bars 16*a*—16*a* of the part 16 can slide longitudinally within the bars 18*a*—18*a* of the part 18.

The inner sides of the upper bars 16*a*,18*a* of the parts 16 and 18, as shown in FIGS. 4, 5, 9 and 10, are provided with a plurality of longitudinally-spaced notches 16*c*,18*c* and by longitudinal adjustment of the parts 16 and 18 relative to each other, predetermined ones of these notches 16*c*,18*c* may be brought into registration and locked in registration, as will appear hereinafter, to hold the sides at a predetermined extension relative to each other.

The end members 16*b*,18*b* at the ends of the sides 10 and 12 have opposed flanges 20,22 which, at the corner, are spaced from each other, designed to draw the side members toward each other while maintaining their guadrilateral relationship. The means 15 for drawing the sides together is like that shown in the aforesaid patents in that, at each corner, there is an air-operated cylinder 26 mounted to the outer side of the flange 20, a piston rod 24 extending through an opening 28 in the flange 20 and through an opening 30 in the flange 22 and a nut 32 on the piston rod at the outer side of the flange 22. A coiled spring 33 is disposed about the piston rod between the flanges 20 and 22. The springs 33 normally hold the sides distended relative to each other and, by supplying pressure to the cylinders 26, the pistons are moved within the cylinders in such a manner as to cause the sides of the jacket to move toward each other.

In the aforesaid patented structures, the side members provided planar surfaces perpendicular to the plane of the jacket for applying pressure to the sides of the mold. In the structure shown herein, the adjustable construction of the side parts makes it desirable to employ panels to provide the necessary planar surfaces for applying pressure to the sides of the mold. One such panel 34 is shown in FIG. 12 as an elongate, rigid plate 36 recessed at one side for receiving a cushion member 38 which may, for example, be asbestos. The plate 36 has fastened adjacent one longitudinal edge a rigid part 40 which is disposed at an acute angle to the surface of the plate, as clearly shown in FIGS. 9, 10 and 12 and, by this means, the panel 34 is suspended along the sides 10—10 on the upper bars 16*a*,18*a* of the parts 16,18 and with its lower part resting against the inner sides of the lower bars 16*a*,18*a*. To hold the suspended plate down, a plate 42 is rigidly attached to the outer side of the panel at right angles thereto as shown in FIG. 10 so as to have engagement with the underside of the bars 16*a*,18*a*. To further hold the panel against the lower bars 16*a*,18*a*, a plate 44 is fixed to the lower bars of one of the parts 16,18 and a magnet 46 is fastened to the plate 44 so that the panel, by engagement with the magnet, will be held securely in place.

On the outer side of the panel 34, approximately midway between its opposite ends, there is fastened a part 48 in the form of a vertically disposed bar of a diameter to become engaged within the notches 16*c*,18*c* and, by such engagement, to lock the parts 16 and 18 at a predetermined adjusted position relative to each other, as shown in FIGS. 9 and 10.

In order to suspend the jacket above a mold to which it is to be applied so that is can be lowered over the mold, there are provided on two of the opposite sides, to wit, the sides 12—12, as shown in FIGS. 1, 3 and 11, hangers 50, each of which comprises a flat plate 52 to which there are fastened in spaced, parallel relation angle members 54 and 56 so spaced apart in parallel relation to each other as to receive between them the top bars 16*a*,18*a* of the parts 16 and 18 without interfering with their sliding interengagement with each other. The angle members 54 and 56 contain notches 54*a*,56*a* for receiving the locking members 48. The top angle member 54 has welded to its ears 58—58 containing holes 60—60 through which the lower ends of cables of lifting tackle may be secured. At the sides 12—12, the panels 34 are suspended from the upper angle member 54 of the hanger 50. In other respects, they are of the same construction as those at the sides 10—10.

It is desirable that when the jacket is lowered over a mold, the side parts have a downwardly and outwardly divergent relation so as to make it easy to drop to jacket over the mold. This is accomplished partly by the suspending tackle, the cords 64 of which converge from the sides 12—12 to their support, not shown, which tends to rock the sides 12—12 outwardly so as to be divergent with respect to each other, and to the fact that the piston rods 24 which connect the plates at the ends of the side parts are of circular cross section and extend through circular holes so that the sides 12—12 are free to turn about their longitudinal axes. To correspondingly rock the side parts 10—10 about their longitudinal axes so as to diverge outwardly and downwardly, there are provided, as shown in FIG. 13, on the flanges 20 protuberances 62 between the outer sides of the flanges 20 and the ends of the cylinders 26. When the jacket is suspended above the mold, the springs 33, by engagement with the flanges 22 and 20, force the side members 10—10 outwardly. When pressure is supplied to the cylinders 26, the side members 12—12 will be moved into parallel relation to each other in engagement with the sides of the mold, as will also the sides 10—10.

As herein illustrated, air is supplied to the cylinders 26 through the piston rods 24 which are, for this purpose, made hollow and by flexible tubing 66.

In the use of the jacket, the sides are permitted to become distended to their maximum longitudinal and transverse spacing for a given size mold by venting air from the cylinders so that the springs 33 force the flange members at the ends of the side members away from each other. In this position, if the jacket is suspended as related above, the side members, including the panels 34, diverge downwardly and outwardly as shown in FIG. 14. If the mold to which pressure is to be applied is of such size as to be accommodated within the four side members, the jacket is lowered over the mold until the panels are opposite the sides, whereupon air is supplied to the cylinders to draw the sides into engagement with the sides of the mold. If the mold is smaller or larger, the sides may be quickly and easily adjusted to the length of the mold by pulling the panels inwardly away from the lower bars of the side members and lifting them off the upper bars of the side members and then sliding the bars of the side members relative to each other to either shorten the overall length or increase the overall length. When the desired length is obtained, the same or panels of different length are suspended upon the sides so as to engage the locking elements 48 with the registering slots and the jacket is ready for use for the larger or smaller size mold to which it is to be applied.

It should be understood that the present disclosure is for the purpose of illustration only and includes all modifications or improvements which fall within the scope of the appended claims.

We claim:

1. A jacket for a multi-sided mold comprising separate side members for each of the sides of the mold, means at the ends of the side members connecting said ends, said means being operable to simultaneously move all of the side members to press each side member against the corresponding side of the mold, each side member being adjustable in length to its side of the mold and comprising longitudinally interengaged parts slidable relative to each other to change its overall length, means for fixing the parts at a predetermined position of elongation and a panel suspended on each side member so as to present a planar surface parallel to the corresponding side of the mold.

2. A jacket according to claim 1 comprising means along one side of each panel for removably suspending it on a side member with its planar surface parallel to the corresponding side of the mold.

3. A jacket according to claim 1 comprising means at two opposite sides of the jacket for movably suspending the jacket over a mold.

4. A jacket to claim 3 wherein said suspending means comprises rigidly spaced upper and lower parallel bars for receiving therebetween the side members and perforated bosses at the top sides of the upper bars of the rigidly spaced upper and lower parallel bars for receiving the lower ends of suspending cables.

5. A jacket according to claim 1 comprising rigid parts attached to the back sides of the panels at acute angles for suspending the panels from the top sides of the side members and rigid parts attached to the back sides of the panels at right angles thereto for engagement with the bottom sides of the side members.

6. A jacket according to claim 1 wherein the means connecting the ends of the side members comprise opposed, spaced-apart plates at the ends of the side members by means of which the side members can be drawn toward the sides of the mold.

7. A jacket according to claim 13 wherein 6 there is spring means disposed between the space apart plates for holding them distended and means for drawing the plates toward each other.

8. A jacket according to claim 7 wherein the means for drawing the spaced apart plates toward each other comprise fluid-operable cylinders containing piston rods which extend from the cylinders through openings in the spaced apart plates, and nuts at the distal ends of the rods.

9. A jacket according to claim 8 wherein the spring means are disposed in compression between the spaced apart plates about the rods.

10. A jacket according to claim 9, wherein the spaced apart plates next to the cylinders are provided with nubs for engagement with the ends of the cylinders.

11. A jacket according to claim 6 comprising means connecting the spaced apart plates at the ends of the side members which permit the side members to turn about their longitudinal axes such as to dispose their inner sides at angles diverging downwardly away from the sides of the mold.

12. A jacket according to claim 1 wherein the slidingly interengaged parts of the side members contain at their inner sides longitudinally-spaced notches, a panel suspended on each side member having a protrusion on its outer side engageable with a pair of aligned notches to hold the parts of each side member in a predetermined position of longitudinal adjustment.

13. A jacket for a multi-sided mold comprising separate side members for each of the sides of the mold, means at the ends of the side members connecting said ends, said means being operable to simultaneously move all of the side members to press each side member against its side of the mold, each side member comprising two pairs of upper and lower spaced parallel bars slidably interengaged to enable adjusting the length of each side member relative to its side of the mold and a panel suspended from the upper bars in engagement with the lower bars, said panel defining a planar surface parallel to the side of the mold.

14. A jacket according to claim 13 comprising means along one longitudinal side of each panel of removably suspending it from the upper bars of a side member with its planar surface parallel to its side of the mold and means along the other longitudinal side of each panel for engagement with the lower bars of a side member.

15. A jacket according to claim 13 wherein the bars are of channel-shaped cross section and the bars of each pair are arranged with their channel facing each other.

16. A jacket according to claim 13 comprising means on the side members for holding the lower parts of the suspended panels engaged therewith.

* * * * *